United States Patent [19]

Egner

[11] 4,165,999

[45] Aug. 28, 1979

[54] MANUFACTURE OF SURFACE ELEMENTS

[75] Inventor: Ernst M. Egner, Lund, Sweden

[73] Assignee: Euroc Development AB, Malmo, Sweden

[21] Appl. No.: 884,338

[22] Filed: Mar. 7, 1978

Related U.S. Application Data

[63] Continuation-in-part of Ser. No. 751,508, Dec. 17, 1976, abandoned.

[30] Foreign Application Priority Data

Dec. 18, 1975 [SE] Sweden ..... 7514324

[51] Int. Cl.[2] ..... B28B 1/32

[52] U.S. Cl. ..... 156/245; 264/248; 264/250; 264/358; 264/359; 264/316; 264/DIG. 57; 425/517

[58] Field of Search ..... 264/248, 250, 308, 316, 264/DIG. 57, 309; 425/517; 156/245, 312

[56] References Cited

U.S. PATENT DOCUMENTS 2,655,710 10/1953 Roensch ..... 264/253 X 3,492,384 1/1970 Matthews ..... 264/250 X

*Primary Examiner*—Thomas P. Pavelko

*Attorney, Agent, or Firm*—Fred Philpitt

[57] ABSTRACT

The present invention is concerned with a method for the manufacture of objects having two shaped surfaces from setting material such as cement and gypsum mixtures. In this method a discrete quantity of the setting material is applied to a mold portion having a surface corresponding to one of the shaped surfaces of the object and is permitted to set therein. The improvement of the invention comprises the application of a discrete quantity of the setting material also to a mold portion having a surface corresponding to the second shaped surface of the desired object. The two mold portions are then brought together to form a mold while the setting material contained therein is still shapable. Hereby the quantities of shapable material are pressed against each other to form the desired object. The latter is then separated from the mold portions.

4 Claims, 9 Drawing Figures

Figure 1:
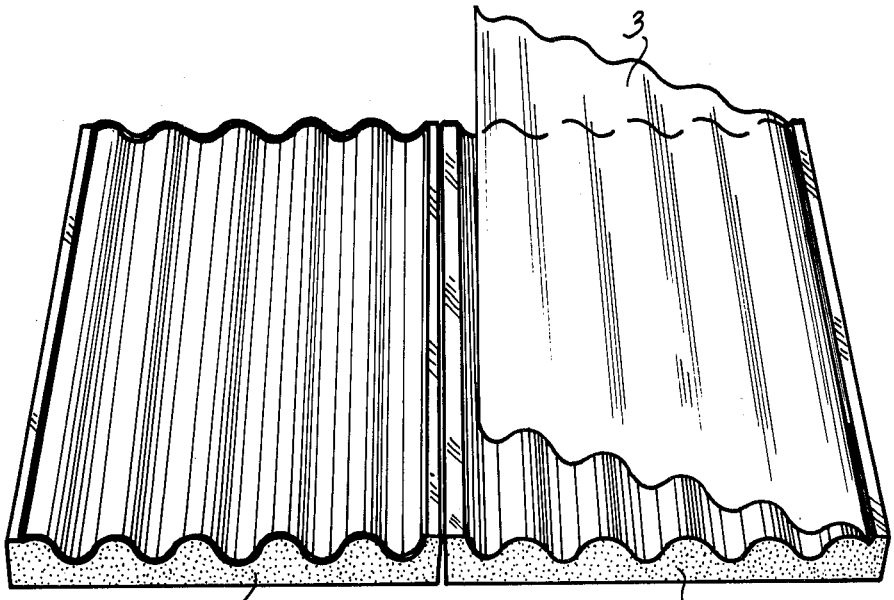

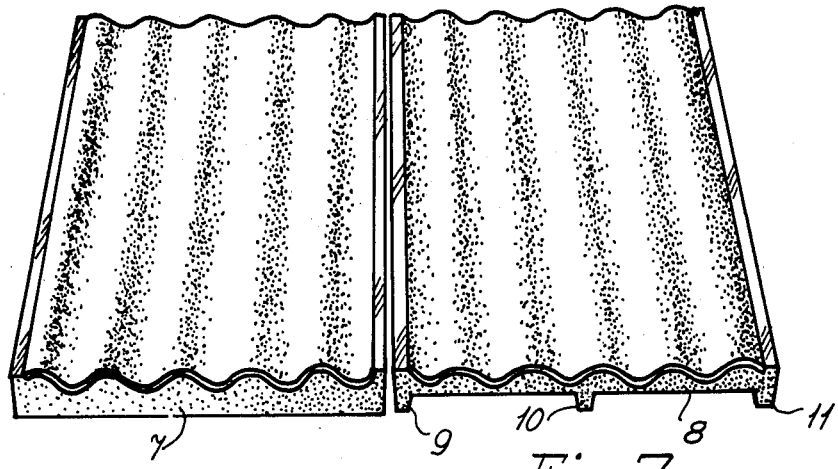
Fig. 7
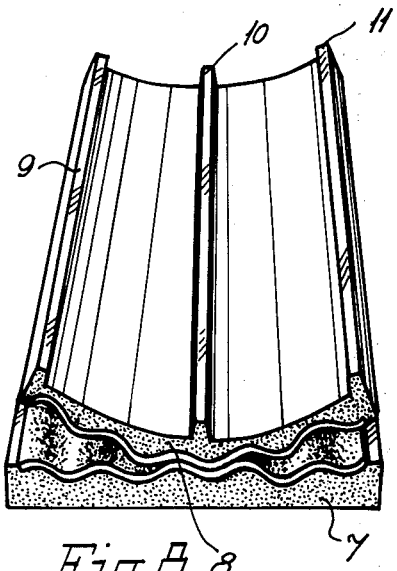
Fig. 8
Fig. 9
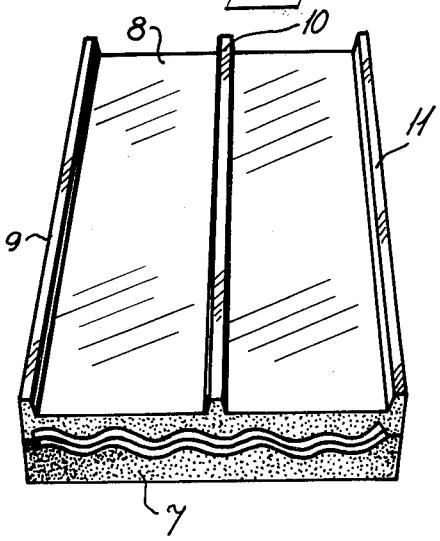

MANUFACTURE OF SURFACE ELEMENTS

This is a continuation-in-part of my application Ser. No. 751,508 filed Dec. 17, 1976, now abandoned.

The present invention is concerned with a method of manufacturing a product having two shaped surfaces.

In the manufacture of building elements it is known to spray a fiber-reinforced binding material, such as a cement-water mixture containing glass fibers, against a molding surface. The molding surface may be planar, of single curvature, of double curvature etc. Normally, the side of the sprayed product facing the molding surface obtains a satisfactory or a good surface finish, provided that the surfaces of the mold and the product exhibit suitably release or parting characteristics. In order to obtain a high-grade homogeneous product, however, it may be suitable to subsequently treat the material applied by spraying in some way or the other. In this respect, certain steps may be taken during the spraying process or immediately thereafter. For example, air-pores in the sprayed material may be removed by subjecting the material to a partial vacuum, by pressing the material or by compressing the material lying against the mold by means of a roller. When applying such techniques, however, it is normally not possible to provide a good surface finish on the surfaces of the material facing the nozzle of the spraying apparatus. Immediately after the spraying operation, this surface is uneven and undulated. When the material is pressed, it is not possible for air trapped in the surface irregularities to escape therefrom, but will remain in the surface of the material to form pores. It is true that the material can be compressed by means of a roller and the binding material optionally vibrated at the same time as the material is sprayed onto a planar mold or, possibly, a mold exhibiting but a single curvature. When this latter technique is used, however, the properties of the binding material must be such that the material will not stick to and be lifted up by the roller.

In accordance with a known technique, the sprayed binding material may be pressed, vibrated and smoothed with a steel plate whilst applying simple method steps. It is possible in this way to obtain a good surface finish, although reproductability with respect to the thickness of the sprayed, pressed and cured product is poor or totally unacceptable for certain fields of use.

It is also known to obtain a smooth and uniform surface by means of one or more knives arranged above a conveyor belt on which molds filled with binding material applied by spraying are advanced at uniform speeds. This method is readily effected and is satisfactory for manufacturing certain types of building elements, but has unacceptable disadvantages with regard to other types of building elements with which the main surfaces of the building elements must exhibit a particularly good surface finish and with which the thickness must lie within precise limits. When manufacturing building elements having surfaces of double curvature or some other intricate surface curvature, the desired surface finish of the building element cannot be obtained by means of this latter technique.

Although building elements produced in accordance with known spraying techniques of the type described above whose thickness lacks the precision necessary for certain usages can be used within certain other fields of use, these building elements still exhibit a multiplicity of disadvantages of varying degree of seriousness. The product must be relatively thick and heavy. It must be dimensioned according to the worst result of a production series. Thus, it is expensive to manufacture. This is of particular significance when the sprayed material is expensive or when an additive therein is expensive. Other disadvantages include those from a pure functional aspect or a pure aesthetic nature.

In the case of a sprayed binding material containing glass fibers, contact between the material and the fibers is often poor, particularly when the material contains a large quantity of fibers and the binding material has a relatively high viscosity. This problem can be solved to a certain extent, by, for example, using an aluminium roller, with which the glass fibers are rolled and pressed into more intimate contact with the binding material. It is not possible with this method, however, to obtain a high-grade product of uniform thickness and with a smooth surface and good surface finish.

It has now been found possible to overcome the disadvantages of products obtained by conventional spraying of the binding material, optionally containing additives, simultaneously onto two mutually adjacent and preferably mutually horizontal mold halves exhibiting surface curvatures which correspond to each of the two desired main surface shapes of the product. Subsequent to spraying the material thereinto, optionally whilst vibrating the mold halves, the mold halves are pressed together with the sprayed material therebetween until the distance between the two halves is equal to the desired thickness of the product. The thus pressed material is then permitted to set or cure and the mold halves separated in order to release the pressed and cured product.

The present invention is concerned with a method of manufacturing objects having two shaped surfaces from setting material in which a discrete quantity of this material is applied to a mold portion having a surface corresponding to one of the shaped surfaces of the object and is permitted to set or cure therein. The improvement comprises applying a discrete quantity of the setting material also to a mold portion having a surface corresponding to the second shaped surface of the object and while the setting material in the mold portions is still shapable, bringing said mold halves together to a mold in which the quantities of shapable material are pressed against each other to form the desired object after which the latter is separated from the mold portions.

It is possible by means of the novel method to produce a product of, inter alia, precise thickness, good surface finish, a high degree of homogenity and of high density in a sequence of application, pressing, curing and releasing steps.

To prevent pockets of air or air-pores forming at the interface or contact surface between the applied quantities of material in the two mold halves when the mold halves are pressed together, the mold halves, prior to and subsequent to the beginning of this pressing operation, are moved towards each other at a certain angle therebetween. In this way it is possible to avoid, to a large extent air being enclosed within the material and the formation of pores in the pressed and cured product.

In accordance with a further embodiment of the invention, at least one of the mold halves is bendable and is curved, for example to parabolic shape, prior to moving the two mold halves together. Subsequent to beginning the pressing operation, the mold halves are gradually levelled out and are optionally completely levelled out upon completion of the pressing operation. When a mold is formable, bendable and bent in this manner, a high degree of precision must be expected of the press-plate urged by the press apparatus against the curved mold. The press-plate functions, together with the bendable mold, as the mold itself. During the pressing operation, one of the mold halves, both of which lie substantially horizontally on a supporting surface subsequent to the spraying operation, can be turned through 180° by means of a gripping device or the like, and moved against the other mold half so that the quantities of sprayed material contained in said mold halves contact each other in a fully overlapping condition. It is assumed here, of course, that the applied material is of high viscosity and that adhesion between the surface of the turned mold half and the applied material is good, so that the contours of the material of the turned mold halves are not deformed or the material drops or falls from the molding surface of the mold halves.

If the contours are likely to be deformed or the material is not likely to adhere satisfactorily to the molding surfaces, each of the two mold halves is turned through only 90° by means of two gripping devices and moved to their rest position against each other with binding material applied by spraying between the mold halves.

A short time after fully completing the pressing operation, the package comprising the two mold halves and the pressed material can be freed from the pressing apparatus and turned to a horizontal position during the setting period.

It has been found particularly convenient with the novel method according to the invention to apply several layers of different binding or curable material mixtures onto each of the two mold halves and to press the laminated material composition between the mold halves in a single step. In this way it is possible to obtain relatively complicated laminated products which are well integrated and symmetrical and which possess good structural properties.

Additional non-sprayable material, such as liquid adhesive, plastic binding compositions and rigid, optionally porous, structural plates can be placed between the layers applied by spraying prior to commencing the pressing operation or in conjunction with the commencement of said pressing operation, although in this latter case the mold halves should be moved together at a certain angle therebetween.

The layered material compositions may be varied in many ways. Firstly, for example, there may be sprayed a thin layer containing an agent which affords the layer suitable release properties with respect to the mould but which preferably lacks a particulate additive. A setting or curable material, such as a binding cement composition or gypsum composition or a curable plastics product, preferably having a reinforcing additive, such as short glass fibers when the material is a cement mixture, is then sprayed in a thicker layer. This can optionally be repeated with the application of two or more similar sprayable and curable material mixtures.

Those layers located adjacent the surfaces of the mold but not constituting an outermost surface layer should be strongly reinforced. The large structural stresses namely occur close to the surface of a building element. For reasons of economy, fibers may be omitted from the thickness-forming and/or accustic and/or thermally insulating intermediate layers, or the amount of fibers incorporated within said layers may be far less than the amount of fibers in the layers adjacent the mold surfaces.

When an additional, non-sprayable material, such as a porous structural plate and a plastics composition, is applied between the layers applied by spraying, the material itself will normally serve as a satisfactory binding system for the additional material, since, prior to the pressing operation, the materials applied by spraying are still wet and have not set or cured; furthermore the contact between the additional material and the applied materials is particularly good as a result of the pressure exerted thereupon during the pressing operation. In the case of certain combination of materials, it may be convenient to use a particular adhesive, which is also the case when no additional, non-sprayable material is used. The adhesive may be poured between or sprayed against the applied layers of material on the surface of the mold halves prior to the pressing operation.

The method according to the invention can also be used advantageously for producing structural plates having composite curvature by means of molds exhibiting surfaces of multiple curvature, particularly when the plates must be manufactured with precise thicknesses and good surface finish. By way of example, a detailed description will be made below of the manner in which a cement roofing tile, of the so-called overtile type reinforced with glass fibers can be produced in accordance with the present invention. Such a tile should not only have a good surface finish on both sides thereof, but the curvature of the tile and its thickness must lie within precise limits.

A first mold half manufactured from sheet steel and having a thickness of 1.5 mm and a second mold half manufactured from vacuum-shaped synthetic resin material and having a thickness of approximately 1 mm were placed on a conveyor belt passing beneath a series of spraying devices at a speed of approximately 0.1 m/sec.; each of said molds having a molding curvature corresponding to the desired curvature of the upper and lower surfaces of the roofing tiles. A thin layer of a substance effective to retard the binding of a cement mixture was sprayed onto both molds.

A binding cement mixture containing glass fibers was sprayed onto the mold halves to a thickness of approximately 2.0 mm, by means of a spray nozzle which reverses perpendicular to the conveying belt at a speed of approximately 1 m/sec. The spraying pattern was of a pronounced elliptic configuration and had the same direction as the conveyor belt, so as to maintain minimum wastage at the mold edges extending parallel to the belt. Every point on the mold surfaces was covered by the spraying pattern approximately six times and the require thickness of the layer was ensured by controlling the amount of material sprayed per unit of time.

A cement mixture containing a considerable smaller quantity of glass fibers than the first mentioned cement mixture was sprayed to a thickness of approximately 1.5 mm on the first layer on the two mold halves, by means of a spraying unit arranged downstream of the first mentioned spray.

Subsequent to completing the spraying operation, the molds on the conveyor belt entered a station provided with mechanical means which, by means of gripping devices, lift the mold halves 90° towards each other and press the mold halves together with the layers applied by spraying therebetween, until the distance between said mold halves is equal to the desired thickness of the roofing tile or approximately 7.0 mm.

The gripping device holding the second mold half, i.e. the mold half made of vacuum-shaped plastics material, is arranged to move said mold half towards the sheet-steel mold at a small angle between the two molding surfaces of said mold halves, thereby to prevent the formation of air pockets and pores in the roofing tile. When the under edges of the mold halves contact each other and the pressing operation commences, a thin, relatively highly viscous cement adhesive is poured in small quantities between the layers applied by spraying until the layers contact each other.

The final pressing position is maintained for approximately five seconds, whereafter the pressure is removed and the two mold halves with the pressed, laminate material composition is lifted in the form of a packet and placed in a horizontal position on other packets obtained in the same manner. Subsequent to a setting and curing time of approximately 24 hours, the roofing tile is removed from the two mold halves. The thin layer of retarding agent between the two mold surfaces and the outer surfaces of the cement product facilitates parting of the cement product from the mold halves and therewith guarantees that the good surface finish is not impaired when separating said product from said mold halves.

A statistical survey of the thicknesses of twenty (20) corrugated cement roofing tiles reinforced with glass fibers and produced in the aforedescribed manner showed an average tile thickness of 7.0±0.5 mm and an average variation within each individual tile of 0.11 mm. A series of roofing tiles manufactured by spraying in a conventional manner and with which the same thickness as that obtained with the tile produced in accordance with the invention was desired, gave an average tile thickness of 7.2±0.80 mm and an average maximum variation within each individual tile of 1.2 mm.

The flexural strength of sample rods sawn from roofing tiles produced in accordance with the invention was found to be greater than that of sample rods taken from tiles produced in a conventional manner: 32.1±1.0 MPa and 26.7±2.2 MPa respectively.

The finish on the upper and lower surfaces of the tiles manufactured by spraying and pressing in accordance with the invention was superior to the finish of the surfaces of tiles manufactured in accordance with conventional methods but not pressed.

The tiles manufactured according to the invention have also a better easthetic appearance than tiles obtained in a conventional manner besides having a high resistance to frost and affording, as a result of the good finish on both the upper and lower surfaces of the tile, a good seal in the overlapping zones of the tiles when laid on the roof.

A high degree of precision of the measurements of the roofing tiles according to the invention is a prerequisite for realising the inventive idea in accordance with the aforementioned patent and an improved sealing of the roof.

Figure 2:
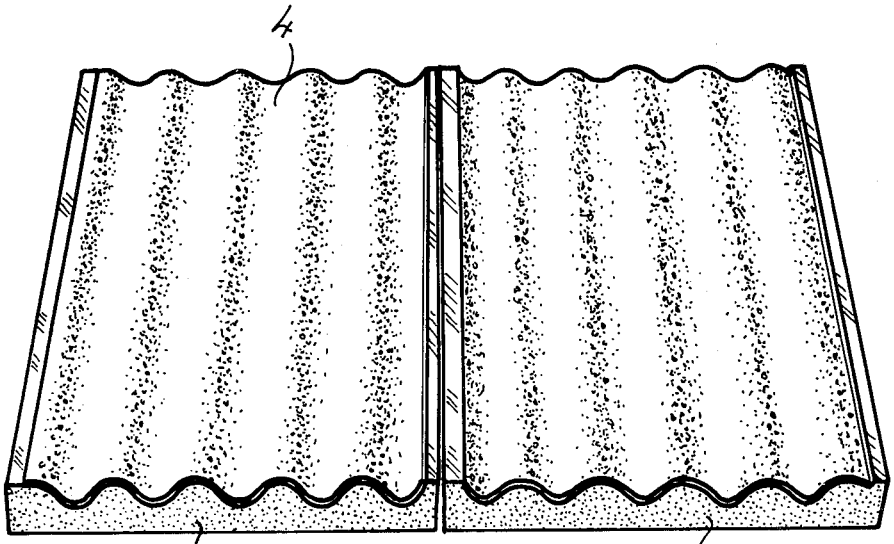
Figure 3:
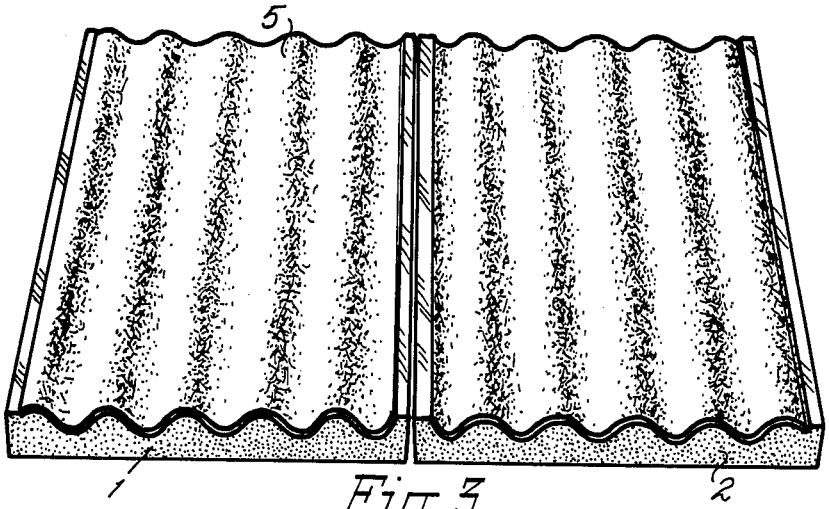
Figure 4:
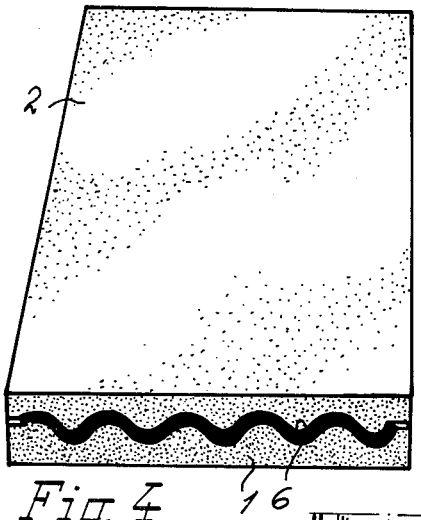
Figure 6:
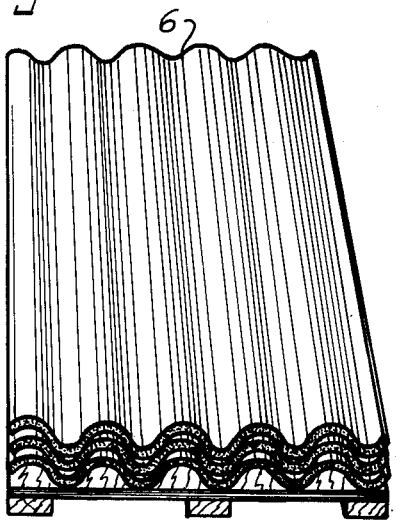
Figure 5:
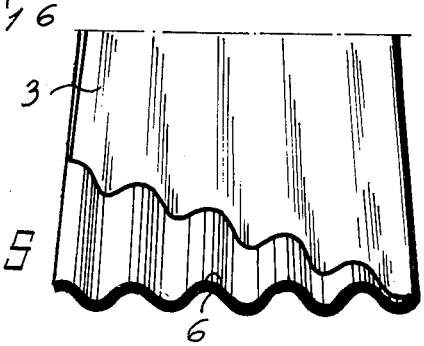

The invention will now be described more in detail with reference to the enclosed drawings, in which FIG. 1 is a perspective view of two mold halves for manufacturing tiles of glass fiber reinforced concrete, said mold being composed of a positive half and a negative half, FIG. 2 shows the mold halves after application of precoat, FIG. 3 shows the same mold halves after application of a mixture of fibers and cement, FIG. 4 shows the positive and negative mold halves after having been joined, FIG. 5 shows the final tile after removal from the mold, FIG. 6 shows a number of tiles stacked for curing purposes, FIG. 7 is a perspective view of two bendable mold portions for manufacturing tiles of glass fiber reinforced concrete according to a slightly modified method after application of a mixture of fibers and cement, FIG. 8 shows the two mold portions after having been brought together, and FIG. 9 shows the same two mold portions in a position when the upper mold portion has been permitted to flatten out to form a complete mold.

With reference to the figures, the manufacture of tiles of reinforced concrete consists of the step of placing two mold halves 1 and 2 on a transport belt. The left one of the halves is a positive mold portion and the right one a negative mold portion. Both mold surfaces are undulated. As evident from what is shown to the right of FIG. 1, the mold halves are each covered with a vacuum-formed also undulated sheet 3 of thermoplastic adapted to serve as a protection to prevent the water in the tile from evaporating in connection with the removal of the tile from the mold after curing. After application of the plastic sheets, the mold halves are transported by the belt to a station (FIG. 2) where a precoat 4 is applied to the surface of the thermoplastic sheets. For the precoat is used an aqueous mixture of sand and Portland cement, said mixture also containing any required color pigment and admixtures. The precoat is applied by spraying a thin layer of the aqueous mixture suspended in a gaseous medium from a spray nozzle arranged above the transport belt.

The composition of the mixture for the precoat is the following:

Portland cement: 1 part
sand and: 0.50 part
water: 0.35 part

By "part" is meant "part by weight".

The mold halves having the precoat applied are then travelled to a station (FIG. 3) where a layer 5 of the starting mixture for the reinforcing mass of the tile is applied. The composition of the latter mixture is as follows:

Portland cement: 1 part
sand: 0.50 part
water: 0.35 part
fibers: 0.1 part

As fiber material are used alkali resistant glass fibers in the form of strands with a diameter of 12 μm, each strand containing 200 filaments. This fiber material has been cut into short fiber portions each having a length between 25 and 50 mm. The reinforcing mass is prepared by blowing a stream of gaseous medium in which the fibers have been suspended into the aqueous mixture of Portland cement and sand thereby to provide a slurry of the fibers in the aqueous mixture. That slurry is applied to the precoat layers previously applied to the undulated surface of the mold portions. As shown in FIG. 4, the two mold halves are then joined. The air present between the halves is pressed out by applying a light pressure to the upper portion of the mold. As a result of the pressing operation, the layers of each of the halves are combined with each other thereby to form the desired tile 6. The mold is then opened and the tile 6 is taken out therefrom with the thermoplastic undulated sheets in contact with the tile, to prevent water in the tile from being evaporated. The tiles are then stacked and left for about 24 hours. During that period, the initial curing of the Portland cement serving as a binder for the sand particles in the concrete takes place so that a tile consisting of fiber reinforced concrete is formed. After the curing has taken place, the thermoplastic sheets 3 can be easily removed from the two big surfaces of the tile 6 preferably by a suction device. The sheets can be used for the manufacture of new tiles. FIG. 5 illustrates the removal of the sheets. The tiles can then be re-stacked and stored in a humid place for further curing for another three weeks or so (see FIG. 6). The edges of each tile can be trimmed and the corners cut off. The tiles can then be sprayed with a water-based acrylic paint unless color pigment or granules are already present in the tile.

Alternatively, it is also possible to proceed in such a manner that the two layers, that is, the precoat layer and the main layer, are applied to previously shaped sheets of thermoplastic material without the latter being supported by the respective mold half. The sheets with applied layers are then joined and placed into the mold. The mold halves are thus used only for the pressing operation thereby to yield the final dimension accuracy. That modified method presupposes that the undulated sheets of thermoplastic present a sufficient thickness and rigidness not to get flattened on spraying the layers thereon. Instead of sheets of thermoplastic it is possible to use any other shapable sheet material such as made of steel.

FIGS. 7–9 are intended to illustrate a slightly modified method for the manufacture of tiles from a settable mixture of cement and fibers. As is the case with respect to the method illustrated in FIGS. 1–6, the present method also uses two mold portions, the left one being designated by numeral 7 and the right one by the numeral 8. Both mold portions have been placed on a flat support. The right mold portion 8 is bendable and in order to maintain the shape thereof it has three supporting ridges 9, 10 and 11 on its under side, said ridges extending in parallel with each other thereby to permit the mold portion of being bent to a cylindrically curved form if said portion is reversed and permitted to take said curved form. A suitable material for the bendable mold portion is rubber. Hereby the right mold portion 8 can be reversed and in the reversed position readily either by the gravity force or by a slight manual action takes the curved form.

The two mold portions 7, 8 are each provided with a layer of settable mixture of cement and fibers. The mixture is sufficiently tacky to adhere at least to the surface of mold portion 8. The settable mixture is suitably applied by spraying a dispersion of the mixture in a gaseous medium from a suitable nozzle (not shown). As soon as the mixture has set sufficiently to adhere to the surface of the bendable second mold portion 8 the latter is seized by the fingers of the operating person and reversed. In the reversed position the bendable mold portion 8 is permitted to take the curved position and is then brought together with mold portion 7 to an incomplete mold as shown in FIG. 8. The mold is completed by permitting the curved surface of the layer applied to mold portion 8 of gradually being brought in contact with the layer applied to the surface of mold portion 7. By the gradual contact of the two layers of settable material it is effectively avoided that air pockets and air pores are formed between the two adhering layers thereby in turn to secure that a continuous tile is formed. The position when the complete mold has been formed is shown in FIG. 9. The molded object can now be completed by pressing the two mold portions together. After the mixture of cement and fibers has set sufficiently, the two mold portions can be separated and the molded object removed from the mold portions. That object can be subjected to further treatment or treatments.

What is claimed is:

1. A method of manufacturing molded objects having two shaped surfaces which comprises:

(a) forming a mixture of a setting material and fibers;

(b) spraying said mixture onto a first mold portion having a surface corresponding to one of the shaped surfaces of the object;

(c) spraying said mixture onto a second bendable mold portion having a surface corresponding to the other shaped surface of the object;

(d) permitting said second bendable mold portion of taking a curved shape;

(e) bringing said first and second mold portions together to form a complete mold and a molded object, said curved second mold portion being gradually flattened out in bringing said portions together thereby to prevent air pockets and air pores in the molded object;

(f) bringing said first and second mold portions further together while pressing to form the completed object, and (g) separating the at least partially set molded object from the mold portions.

2. A method according to claim 1, wherein at least one mold portion exhibits at least a single-curved molding surface.

3. A method according to claim 1, wherein a layer of adhesive is applied between the layers on said mold portions.

4. A method as set forth in claim 1, wherein the second bendable mold portion is permitted to take parabolic shape prior to moving the portions together.

* * * * *